US005989093A

United States Patent [19]

Nelson et al.

[11] Patent Number: 5,989,093

[45] **Date of Patent: *Nov. 23, 1999**

[54] BALLOON WEIGHT AND RIBBON ASSEMBLY

[75] Inventors: David C. Nelson, 2727 N. Revere Rd., Akron, Ohio 44333; Michael J. Frazier, Waterloo, Wis.; Michael J. Fresh, Copley, Ohio; John W. Schneiter, Sun Prarie, Wis.

[73] Assignee: David C. Nelson, Akron, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/844,356

[22] Filed: Apr. 18, 1997

[51] Int. Cl.[6] ..... A63H 3/06

[52] U.S. Cl. ..... 446/220; 446/79

[58] Field of Search ..... 446/49, 51, 53, 446/79, 220, 235; 244/31

[56] References Cited

U.S. PATENT DOCUMENTS

| | | | |
|---|---|---|---|
| 4,936,532 | 6/1990 | Williams | 248/205.3 |
| 5,011,447 | 4/1991 | Watanabe | 446/220 |
| 5,240,199 | 8/1993 | Peters | 242/96 |
| 5,514,022 | 5/1996 | Harris | 446/75 |
| 5,573,437 | 11/1996 | Van Dyke et al. | 446/75 |
| 5,628,091 | 5/1997 | Mueller | 24/3.2 |
| 5,797,783 | 8/1998 | Harris | 446/77 |

*Primary Examiner*—Robert A. Hafer
*Assistant Examiner*—Laura Fossum
*Attorney, Agent, or Firm*—Renner, Kenner, Greive, Bobak, Taylor & Weber

[57] ABSTRACT

A balloon weight and ribbon assembly includes a spool having a length of ribbon wound thereabout, the ribbon being secured at one end to the spool and at the other end to a breakaway tab which initially comprises a part and parcel of the spool. A dimple in the tab accommodates receipt of a double knot at one end of the ribbon, while a slot in the spool accommodates receipt of a double knot of the ribbon at the opposite end. A piece of double backed adhesive tape is provided on the breakaway tab to allow for securement of the tab to the neck or tail of an inflated balloon.

10 Claims, 2 Drawing Sheets

BALLOON WEIGHT AND RIBBON ASSEMBLY

TECHNICAL FIELD

The invention herein resides in the art of balloon devices and accessories. More particularly, the invention relates to a balloon weight adapted to be tethered to an inflated balloon to restrain the balloon. Specifically, the invention relates to a balloon weight having a receptacle for a desired length of ribbon, the ribbon being adapted for ease of application and securement to a balloon. Specifically, the invention relates to a balloon weight and ribbon assembly in which the balloon weight comprises a spool receiving the ribbon and having a break-away tab connected thereto which is adapted for adhesive connection to the balloon, the ribbon being interconnected between the tab and the weight spool.

BACKGROUND ART

The use of balloons as a "favor" or at parties, celebrations, and other events is now extremely well known. Millions of balloons are so used each year. Generally such balloons are attached to either a stick and a cup or a ribbon so that they can be restrained by the user. Additionally, the balloons are typically filled with helium gas to provide a "lift", allowing them to stay aloft at the end of the tethered ribbon or stick. Of particular concern of many localities is assurances that such inflated balloons are restrained from free flight into electrical power lines and transformers as well as the atmosphere. Particular concern exists with respect to Mylar or metallic balloons, which pose a threat to electrical transmission wires, and which are not biodegradable. Many municipalities and other governmental agencies consider such balloons to pose at least some threat to the environment. Accordingly, many governmental agencies require that such metallic balloons be tethered to a weight, with the weight being sufficient to prevent the balloon from free flight into the atmosphere.

It has previously been known to employ a weight at the end of a ribbon tethered to a balloon, to restrain the balloon from free flight. Most often, there is a necessity for the retail clerk to cut a length of ribbon, attach one end of it to the weight, and to knot or otherwise attach the opposite end to the balloon. The operation is extremely time consuming, and occasionally ineffective. To hasten the operation by the retail clerk, some balloon weights have been provided with a pre-attached length of ribbon, such that the retail clerk need only attach the opposite end to the balloon. Again, such attachment is typically made by tieing and knotting. Moreover, in the prior art the actual securement and winding of the ribbon to the weight is quite labor intensive, with the operation not being conducive to automation.

DISCLOSURE OF INVENTION

In light of the foregoing, it is an aspect of the instant invention to provide a balloon weight and ribbon assembly in which a single assembly includes a weight, a desired length of ribbon, and securement means for attaching the ribbon to a balloon.

Another aspect of the invention is the provision of a balloon weight and ribbon assembly in which the balloon weight comprises a spool, about which a length of ribbon is pre-wound.

Still a further aspect of the invention is the provision of a balloon weight and ribbon assembly in which the ribbon is securely attached to the weight at one end thereof, and is adapted for adhesive attachment to the balloon at the opposite end.

Yet another aspect of the invention is the provision a balloon weight and ribbon assembly in which the balloon attachment mechanism consists of a breakaway tab which is initially secured to the weight itself, and where a ribbon is interconnected between the weight and the breakaway tab.

Still a further aspect of the invention is the provision of a balloon weight and ribbon assembly which is given to ease of manufacture and implementation through automation.

Yet another aspect of the invention is the provision of a balloon weight and ribbon assembly which is aesthetically pleasing, simple to manufacture, and cost effective in use.

The foregoing and other aspects of the invention which will become apparent as the detailed description proceeds are achieved by a balloon weight and ribbon assembly comprising: a receptacle; a ribbon received by said receptacle; and a securement member carried by said receptacle and adapted for attachment to a balloon.

DESCRIPTION OF THE DRAWINGS

For a complete understanding of the objects, techniques, and structure of the invention reference should be made to the following detailed description and accompanying drawings wherein.

BEST MODE FOR CARRYING OUT THE INVENTION

Figure 1:
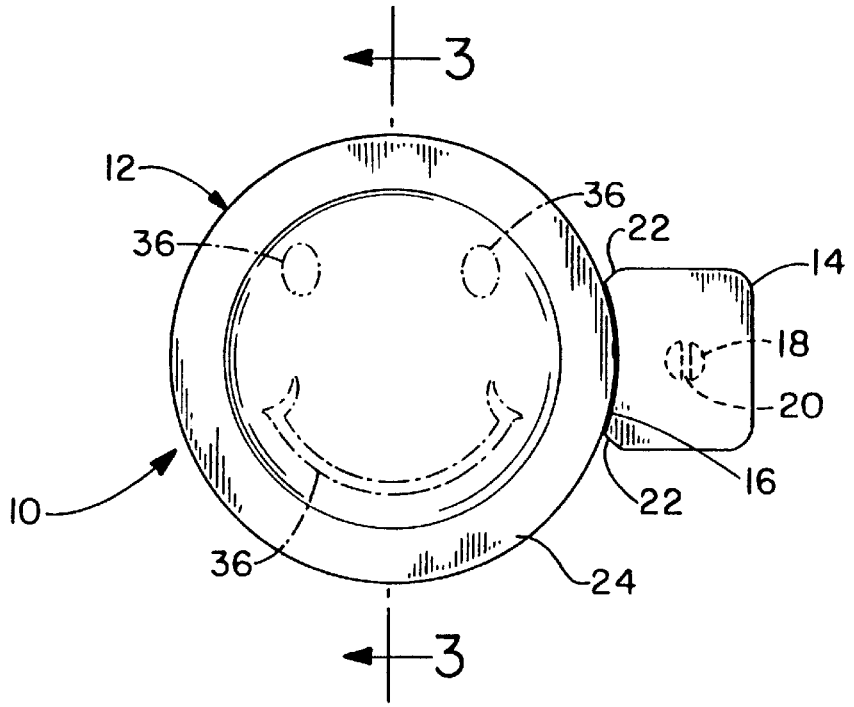
FIG. 1 is a top plan view of the balloon weight and ribbon assembly according to the invention.
Figure 2:
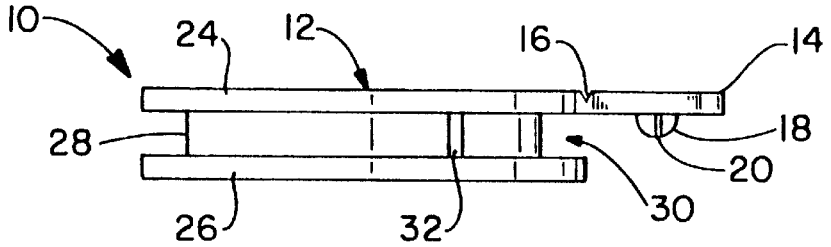
FIG. 2 is an edge elevational view of the balloon weight of FIG. 1.
Figure 3:
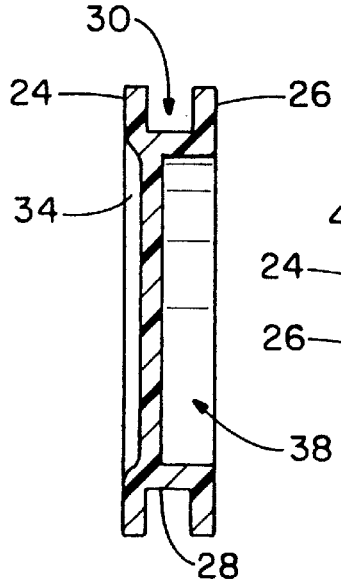
FIG. 3 is a cross sectional view of the balloon weight of FIG. 1, taken along the line 3—3.

With reference now to the drawings, and more particularly FIGS. 1–3, it can be seen that a balloon weight made in accordance with the invention is designated generally by the numeral 10. The balloon weight 10 includes a body portion 12 which, as will become apparent herein, is configured as a spool. Attached to the body portion 12 is tab 14. A score line 16 continues the circumference of body portion 12 and comprises a weakened line of depression, allowing for the tab 14 to be easily broken from the body portion 12. It will be appreciated that the balloon weight 10 is preferably molded of plastic and, accordingly, the score line 16 provides a reliable means for allowing the tab 14 to be broken away from the body portion 12.

It will be particularly noted that the tab 14 is characterized by a centrally positioned dimple 18 having a slot 20 extending therethrough. It will further be noted that tab 14 is characterized by angled corner pieces 22 which are provided to assure that when the tab 14 is broken away from the body portion 12, no sharp edges are exposed. Accordingly, the angled corner pieces 22 are defined by being angled inwardly toward a tangent of the circumference of the body portion 12. In a preferred embodiment of the invention, the angled corner pieces form an angle of 30°–60° with the side edges of the tab 14, and in the preferred embodiment, the angle is 45° therewith. It is further contemplated that the corner pieces could be fully radiused to achieve this result.

As shown in FIGS. 2 and 3, the body portion 12 consists of a top disk 24, from which tab 14 extends with the demarkation of the score line 16. Spaced below and parallel with the top disk 24 is a bottom ring 26. A cylindrical wall 28 is interposed between the top disk 24 and bottom ring 26. The area between the top disk 24, bottom ring 26, and cylindrical wall 28 defines a ring-like cavity 30 adapted to receive a wound length of ribbon. It will be appreciated that the elements 24–28 define a spool for that purpose.

It will further be appreciated that a slot 32 is provided in the cylindrical wall 28. The slot 32 passes through the wall 28 and into the cylindrical cavity 38. The slot 32 provides a means for receiving and retaining one end of a ribbon, as will be discussed below. It will further be noted that the top disk 24 may have a dish-shaped top surface 34, as illustrated. Moreover, decorative features, shown in phantom at 36, may be molded into or otherwise carried by the dish-shaped surface 34 of the top disk 24.

Figure 4:
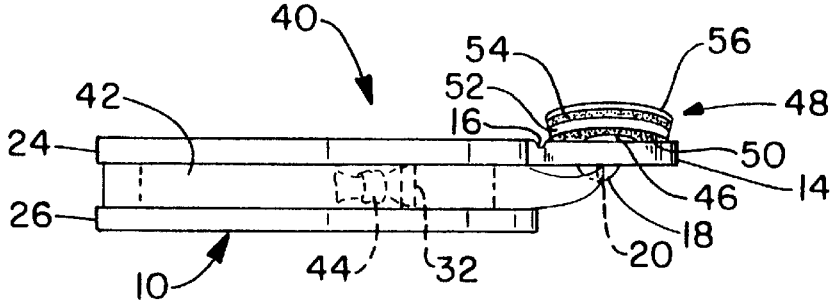
FIG. 4 is an edge elevational view of a balloon weight and ribbon assembly according to the invention.

With reference now to FIG. 4, it can be seen that a balloon weight and ribbon assembly according to the invention is designated generally by the numeral 40. Here, the balloon weight 10 has been provided with a precut length of ribbon 42 wound about the spool defined between the top disk 24, bottom ring 26, and cylindrical wall 28.

The ribbon 42 is passed through the slot 32 and double knotted within the cylindrical cavity 38, thus securing it to the weight 10. The spool of the balloon weight 10 may then be appropriately mounted to a suitable automatic winding machine, in which a predetermined length, such as 6 feet of ribbon may be wound around the spool. The opposite end of the length of ribbon 42 is then passed through the slot 20 of the dimple 18 on the underside of the tab 14 and double knotted within the dimple on the top side thereof, thus securing it to the tab 14. The dimple provides a cavity to receive the knot such that the tab 14 maintains a flat planar surface.

With the ribbon double knotted in the cylindrical cavity 30 at one end thereof, wrapped about the spool of the weight 20, and double knotted within the dimple 18 at the opposite end thereof, a single unitary tethered weight assembly is defined. To provide a means for securing the weight to a balloon, a piece of double backed tape 48 is provided. While the double backed tape may take any of various configurations, according to one embodiment of the invention, a piece substantially equal in size to tab 14 is attached to the top surface of the tab 14, and over the double knotted end 46 of ribbon 42 received within the dimple 18. An adhesive layer 50 makes such engagement. According to one embodiment of the invention, the double backed tape may include a foam layer 52 over which an adhesive layer 54 is laid. A release liner 56 is placed over the adhesive layer 54, and is adapted for removal to expose the adhesive layer 54 when desired. It is contemplated that other means might be employed to secure the tab 14 and associated ribbon 42 to the neck or tail of the balloon, such as any suitable adhesive sonic welding or heat staking.

The assembly as shown in FIG. 4 may be stocked by a retail outlet for employment with a balloon upon request. When a balloon is requested by a customer, the balloon is simply inflated and sealed at the neck or tail thereof as by a self sealing valve or the like. The release liner 56 is then removed from the double backed tape 48, exposing the adhesive layer 54. The adhesive layer 54 is then secured to the neck or tail of the balloon such that the balloon now includes the tethered weight assembly. At the point of sale, before or after attachment of the adhesive layer 54 to the balloon, the tab 14 may be broken from the body portion 12 by simply flexing the tab about the score line or fracture line 16. In some instances, the customer may simply request that the tab 14 be left intact, to be separated from the body portion 12 when the balloon arrives at home or its final destination. In other instances, the tab may be broken away at the point of sale.

Figure 5:
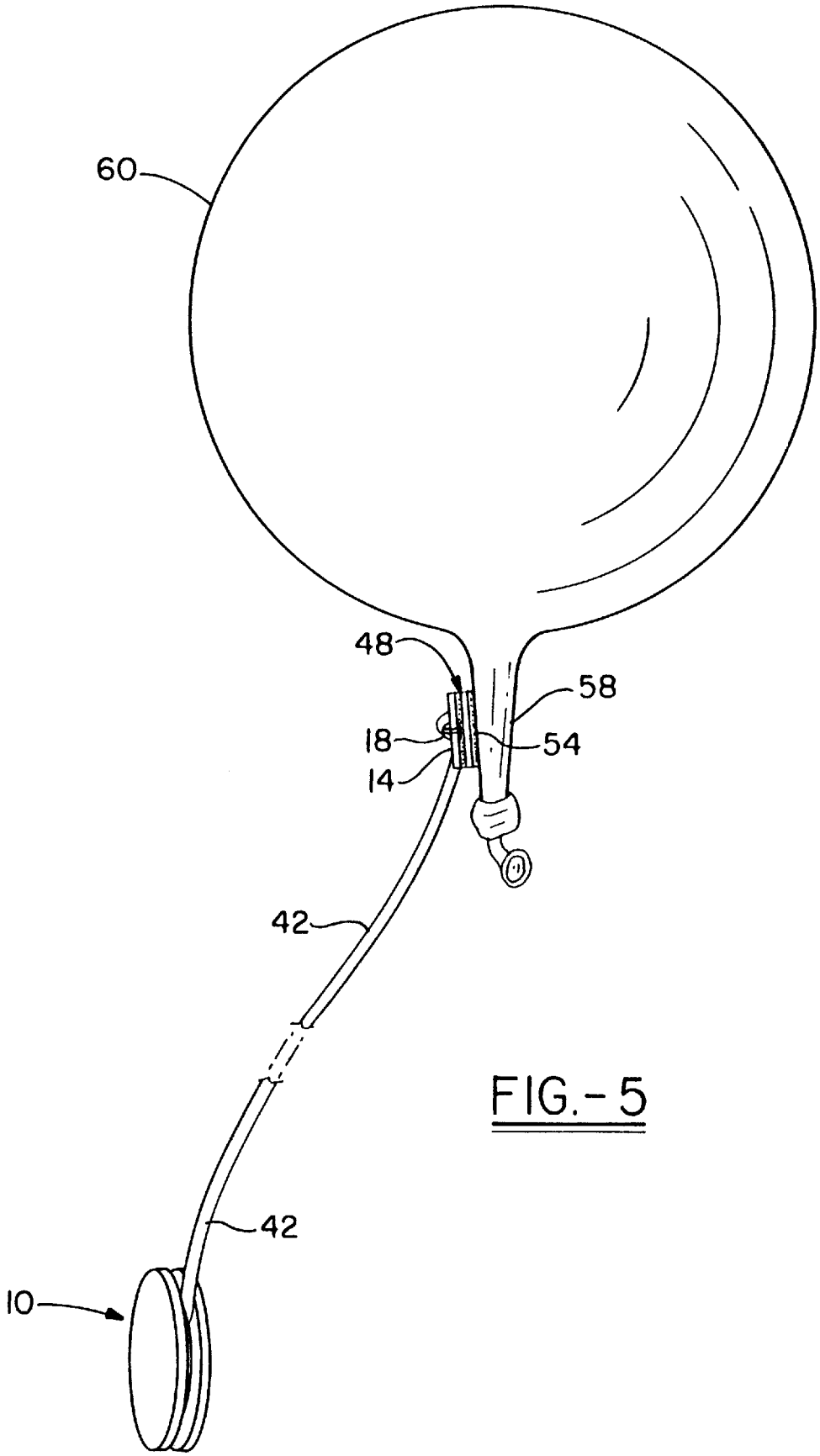
FIG. 5 is an illustrative view of the balloon weight and ribbon assembly of the invention, employed with a balloon attached.

As shown in FIG. 5, the balloon weight 10 is tethered by a length of ribbon 42 to an inflated balloon 60. The sealed tail or neck 58 of the balloon 60 receives the tab 14 of the balloon weight assembly 10 as through adhesive attachment by double backed tape 48, as illustrated. With the weight 10 being of sufficient mass to overload the lift of the inflated balloon 60, it is assured that the balloon 60 will remain tethered to the weight 10, and prevented from free flight into the atmosphere or power lines.

The balloon weight and ribbon assembly presented herein assures that the end of the ribbon to be attached to the balloon is always oriented in the same location—attached to the breakaway tab. Moreover, the balloon weight and ribbon assembly constitutes a totally self contained unit, with the weight, ribbon, and balloon attachment means all contained in a unitary piece.

It should now be appreciated that the balloon weight and ribbon assembly disclosed herein provides a single unitary easy-to-use assembly which allows for securement of a tethered balloon to a weight. The balloon weight and ribbon assembly is easily manufactured and is given to automation in spool winding. The double knotted attachment of the ribbon to both the spool and the tab assures that the balloon will not break away from the weight, while the double backed adhesive tape or other securement means assures that the retail clerk can effect secured engagement of the balloon weight to the balloon at the point of sale.

Thus it can be seen that the objects of the invention have been satisfied by the structure presented above. While in accordance with the patent statutes only the best mode and preferred embodiment of the invention has been presented and described in detail the invention is not limited thereto or thereby. Accordingly, for an appreciation of the true scope and breadth of the invention, reference should be made to the following claims.

What is claimed is:

1. The combination of a balloon and a balloon weight and ribbon assembly, comprising:

a balloon inflated with a gas providing a lift to said balloon;

a spool of a mass sufficient to overload said lift of said balloon;

a tab releasably secured to said spool; and a ribbon secured at a first end to said spool and at a second end to said tab, said tab having an adhesive thereon for securing said tab to said ribbon.

2. The combination of a balloon and a balloon weight and ribbon assembly according to claim 1, wherein said spool comprises a top disk and a bottom ring spaced apart and receiving said ribbon therebetween.

3. The combination of a balloon and a balloon weight and ribbon assembly according to claim 2, wherein said tab has a dimple therein, said dimple having a slot passing therethrough, said first end of said ribbon passing through said slot, said ribbon being knotted at said first end, said knot being received in said dimple.

4. The combination of a balloon and a balloon weight and ribbon assembly according to claim 2, wherein a cylinder connects said top disk and bottom ring, said cylinder having a slot therein receiving said second end of said ribbon.

5. The combination of a balloon and a balloon weight and ribbon assembly according to claim 4, wherein said adhesive comprises an adhesive tape.

6. The combination of a balloon and a balloon weight and ribbon assembly according to claim 5, wherein said adhesive tape comprises a double sided adhesive.

7. A balloon weight and ribbon assembly, comprising:

a spool defined by a cylinder having a disk on one end thereof and a ring on an opposite end thereof;

a ribbon wrapped about said cylinder, said ribbon having a first end thereof passing through said cylinder; and a tab releasably attached to said spool, a second end of said ribbon being secured to said tab, said tab having an adhesive thereon for securing said tab and second end of said ribbon to a balloon.

8. The balloon weight and ribbon assembly according to claim 7, wherein said adhesive also secures said ribbon to said tab.

9. The balloon weight and ribbon assembly according to claim 8, wherein said adhesive comprises an adhesive tape.

10. The baboon weight and ribbon assembly according to claim 9, wherein said tab is integral with said spool.

* * * * *